United States Patent [19]

Calamani et al.

[11] 4,037,802

[45] July 26, 1977

[54] APPARATUS FOR STORING AND FEEDING YARN TO YARN USING MACHINES

[76] Inventors: Sergio Calamani, Via Settima, 27, Segrate San Felice, Milan; Eugenio Turri, Via Benedetto Marcello, 1; Ermanno Savio, Via Garofalo 22, both of Milan, all of Italy

[21] Appl. No.: 565,608

[22] Filed: Apr. 7, 1975

[30] Foreign Application Priority Data

| | | |
|---|---|---|
| Apr. 10, 1974 | Italy | 21212/74 |
| Aug. 7, 1974 | Italy | 26113/74 |
| Oct. 21, 1974 | Italy | 28631/74 |

[51] Int. Cl.[2] ..... B65H 51/20

[52] U.S. Cl. ..... 242/47.05; 242/47.01; 242/47.12

[58] Field of Search ..... 242/47.05, 47.04, 47.01, 242/47.12, 47.13, 128

[56] References Cited

U.S. PATENT DOCUMENTS

| | | | |
|---|---|---|---|
| 2,128,487 | 8/1938 | Klein | 242/128 |
| 2,479,826 | 8/1949 | Frick et al. | 242/128 |
| 2,649,645 | 8/1953 | Cole | 242/47.05 |
| 3,425,647 | 2/1969 | Kovaleski et al. | 242/128 |
| 3,672,590 | 6/1972 | Rosen | 242/47.12 |
| 3,687,384 | 8/1972 | Rosen | 242/47.12 |
| 3,702,176 | 11/1972 | Rosen | 242/47.01 |
| 3,776,480 | 12/1973 | Lawson | 242/47.12 X |
| 3,796,386 | 3/1974 | Tannert | 242/47.12 |
| 3,831,875 | 8/1974 | Jacobsson | 242/47.01 X |
| 3,834,635 | 9/1974 | Pfarrwaller | 242/47.01 |
| 3,940,079 | 2/1976 | Vella | 242/47.12 |
| 3,995,786 | 12/1976 | Deniega | 242/47.01 |

*Primary Examiner*—Stanley N. Gilreath

[57] ABSTRACT

Apparatus for storing yarn drawn off from a spool and feeding it with a controlled tension to a yarn using machine. The apparatus comprises a drum having an axial central hole and a rotating arm drawing the yarn off from the spool and winding it up as windings on the drum, from which the yarn is then drawn off through the central hole. The displacement of the yarn windings along the drum surface is carried out by swinging blades alternatively projecting and moving upwardly through grooves provided on the drum. These blades keep the yarn windings separated from one another during translation on the drum, each of the windings being arranged between two successive blades. A bell is located at the top of the drum and brakes the balloon built up by the yarn drawn off from the drum, while flexible fingers act upon the drawn off yarn, controlling the tension thereof.

12 Claims, 5 Drawing Figures

FIG. 1
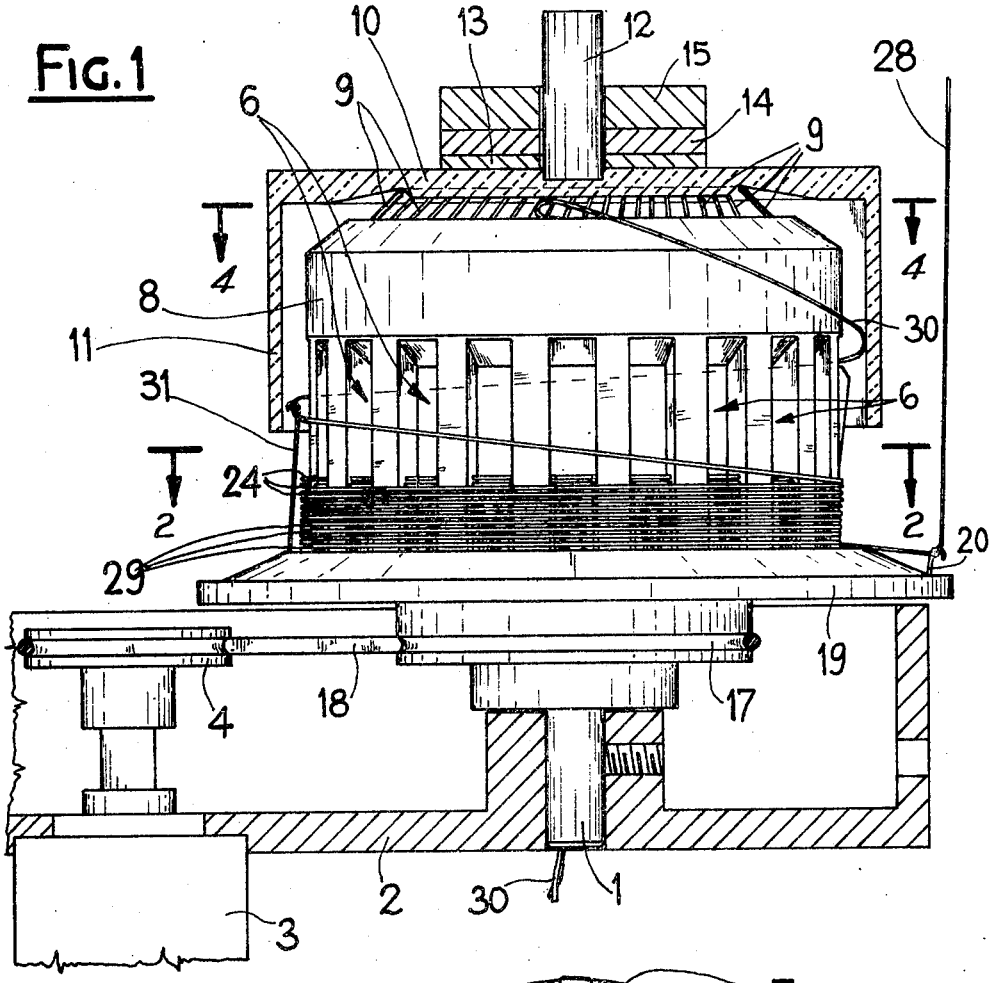
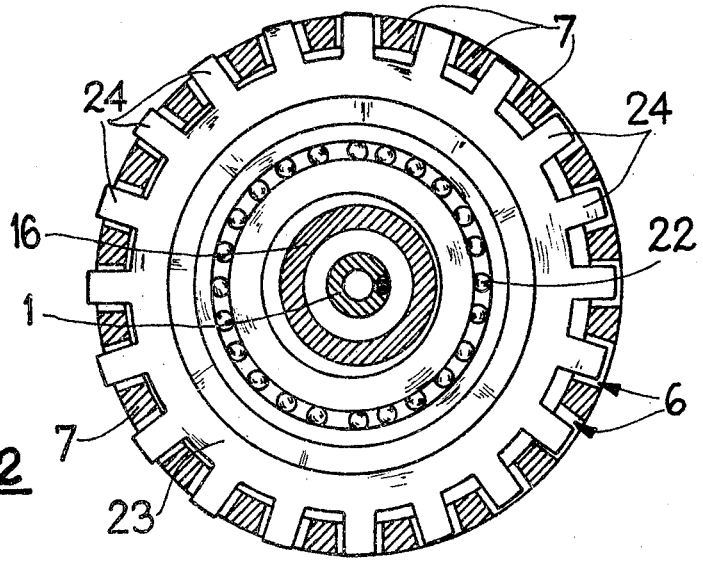
FIG. 2

APPARATUS FOR STORING AND FEEDING YARN TO YARN USING MACHINES

FIELD OF THE INVENTION

This invention relates to an apparatus for storing and feeding yarn to yarn using machines, and more particularly the invention relates to an apparatus for feeding yarn at a constant tension or in a constant amount per time unit to yarn using machines, such as looms, particularly shuttless looms, knitting machines, stocking frames and the like.

BACKGROUND

It is well known that yarn using machines, such as said knitting machines, yarn is not directly supplied from a spool, cop, reel or the like, but such yarn arrives from the spool to the yarn machine after having been previously wound up on an apparatus, where a reserve or supply of yarn is built up and then delivered to the yarn using machine with constant and controlled tension or with constant lengths of yarn per time unit.

The known apparatus is substantially in the form of a drum, to one end of which turns or windings of yarn are wound, the yarn being drawn off from the other end of the drum. Rigid and swinging mechanical members are then provided which act on the windings of yarn wound on the drum, causing translation thereof from that end of the drum, to which they are fed, to the other end where the yarn is drawn off. In some apparatus, such as those disclosed in published German Patent Application No. 2,301,416, U.S. Pat. No. 3,796,386, French Patent No. 1,285,954 or corresponding German Patent No. 1,191,197, the yarn being drawn off passes through a hole in the central portion of the drum on which the yarn windings are wound.

For the translation of the yarn windings along the outer surface of the drum, mechanical members of different nature are known. In accordance with the above cited patents, as well as U.S. Pat. Nos. 3,419,225 and 2,625,340 and still other patents, adjacent that end of the drum where yarn winding is carried out, provision is made for a disc or plate swinging relative to the drum, this disc or plate having an arc of its surface always contacting a section of that winding of said windings which is closest thereto. Plate oscillation takes place about an axis which is inclined with respect to the drum axis, so that the contact zone between said plate and the yarn winding adjacent thereto continuously changes throughout the drum periphery. Thus, said plate urges or pushes the winding off, leaving a free space, in which another winding is continuously distributed. That winding which is pushed off by the plate, in turn pushes the winding adjacent thereto, the latter pushing off the next winding, and so on, causing a simultaneous displacement of the whole winding package wound up on the drum.

This winding translation system suffers from serious disadvantages residing, for example, in that with particular yarns the windings tend to overlap, the windings tend to bind against one another if the yarn is of a pile character, and should the yarn break at any location, the windings would loosen and overlap, making it difficult to find out the free end of the broken yarn.

Also other systems are known for yarn displacement on the drum, such as that disclosed in U.S. Pat. No. 1,052,212, wherein the apparatus comprises two sets of circumferential bars and members for radially and axially moving each set of bars relative to the other set, so that each set of bars alternatively takes up the yarn wound up about said sets of bars, axially displaces it and allows it to move on the other set of bars. Also this displacement or translation system for yarn windings has substantial shortcomings residing, for example, in that the windings have a tendency to freely drop or fall down and overlap (which is avoided by importing a high tension to the yarn incoming on the apparatus), no control for the position of the yarn windings is available, and still that, should a yarn break, windings would tend to fall down and it would be difficult to find out the free end of the broken yarn.

In some apparatus of the prior art, in which the drum rotates about its own axis, an additional shortcoming then arises in that the yarn, at limited sections of its length, may undergo objectionable twist changes at steps wherein the using machine does not draw off any yarn, while the involved apparatus continues to rotate.

In many apparatus of the prior art, the yarn being drawn off therefrom, would freely run off, that is without any brake, so that, particularly should the yarn be drawn off intermittently and at high speed, upon sudden discontinuity of this drawing off, the yarn may all the same run off the drum by inertia and accordingly overlap or build up knots. In order that this be avoided, it has been proposed that the peripheral surface of the drum should be acted on by an element for braking and controlling the tension of the outgoing yarn, the element comprising a ring having flexible fingers projecting herefrom and bearing on the drum. These fingers are deflected by the yarn being drawn off, controlling the tension thereof. Such a type of braking device is disclosed, for example, in U.S. Pat. No. 2,838,922.

The braking devices of this character suffer from disadvantages residing, for example, in being suitable to provide a fixed constant tension, and in that at the start of rotation of the drum about its own axis, the device applied thereto tends to slip and accordingly to run off and to overlap the yarn windings adjacent thereto.

The prior art apparatus suffers then from a further shortcoming, in that when the yarn is run off at high speed from the drum forming part of each apparatus, the yarn running off from the drum forms a balloon due to the centrifugal force, that is the yarn tends to be moved away from the drum to a large extent, thus making impossible any control on the speed and tension of the outgoing yarn.

SUMMARY OF THE INVENTION

It is the primary object of the present invention to provide an apparatus in which the tension of the outgoing yarn can be easily varied within wide rate ranges and wherein the windings would up on a storing drum can be moved along the drum, each winding remaining separated and spaced apart from the winding adjacent thereto, thus avoiding any overlapping of the windings which may also occur in case of yarn breakage.

Another object of the invention is to provide an apparatus of the above character, in which any balloons developed by yarn running off from the drum can be easily controlled, such apparatus being capable of supplying a yarn using machine with yarn at constant tension and a length of yarn which is constant per unit of time.

These and still other objects are accomplished by an apparatus comprising a substantially upright hollow shaft, the upper end of which is fast or integral with the upper end of a substantially cylindrical drum surrounding said shaft, an arm provided with members for hooking the yarn from a spool or the like and distribute such a yarn as windings on the drum surface adjacent its lower end, a drive member for causing a relative rotational motion between said arm and drum, and a swinging body for causing said yarn windings to be translated from the lower to the upper end of the drum, where the yarn is run and drawn off through the bore of the hollow shaft to be supplied to a yarn using machine, the apparatus being characterized in that said hollow shaft carries at least one rolling bearing supporting a bush or sleeve having said distributor arm fast therewith and which is acted upon by said drive member to rotate the bush or sleeve relative to the hollow shaft, said drum being at least partially passed through by a plurality of longitudinal slits distributed all about the drum periphery, said sleeve or bush carrying at least one rolling bearing having its axis inclined to an eccentric with the shaft axis and supporting an annular body, a plurality of blades or rigid fingers outwardly radially projecting from the periphery of said annular body, said blades being distributed in groups in which they are superimposed and spaced apart from one another, one group of said blades being positiond and swingable in each separate longitudinal slit of said drum, above said drum a bell is positioned with a base wall spaced apart from the drum top and having a substantially cylindrical peripheral wall spaced apart from the outer surface of the drum, the bell being supported and spaced apart from the drum top by a device comprising an annular element coaxial with the hollow shaft, having a plurality of flexible elongate thin fingers having a free end, projecting therefrom such fingers being inclined in the yarn movement direction during running off from the apparatus.

BRIEF DESCRIPTION OF THE DRAWING

In order that the structure and features of the device be more clearly understood, an embodiment thereof will now be described with reference to the accompanying drawings, in which:

FIG. 1 is a side elevational view partly cut away in section of the apparatus;

FIGS. 2 and 3 are sectional views of the apparatus, as taken along line 2—2 in FIG. 1, FIG. 3 being a schematic view relative to that of FIG. 2 and having the rotating portion of the apparatus rotated by 90° relative to said FIG. 2;

DETAILED DESCRIPTION

Figure 4:
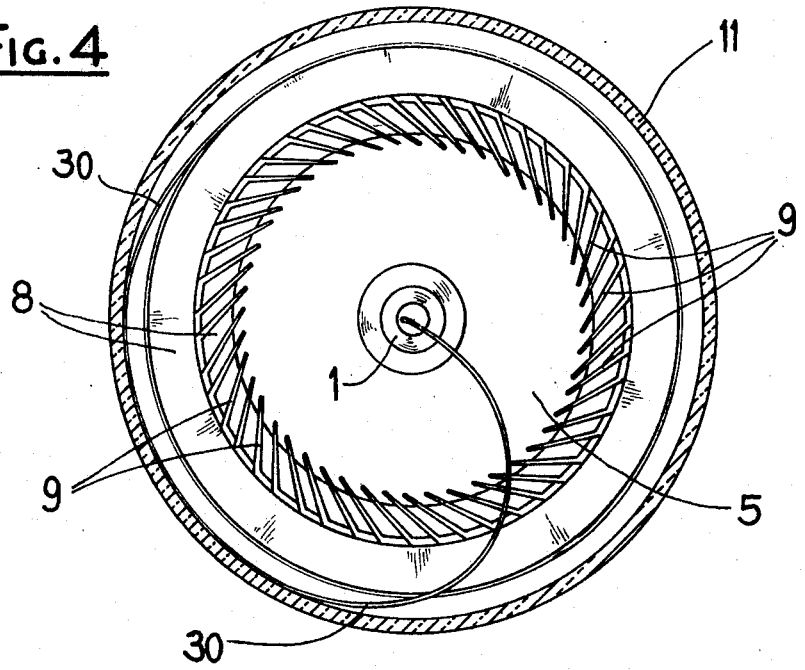
FIG. 4 is a sectional view of the apparatus, as taken along line 4—4 in FIG. 1.

As it will be seen in the figures of the drawings, the apparatus according to the invention comprises an upright hollow shaft 1 fast with a bracket 2, the latter having fast therewith an electric motor 3 provided with driving pulley 4. The upper end of shaft 1 has a drum fast therewith, as formed of a plate 5 and a substantially cylindrical peripheral wall surrounding shaft 1. This peripheral wall has a plurality of longitudinal slits 6 formed therein and defined by longitudinal rods 7. Above said plate 5, a plate 8 is positioned (having, as plate 5, a central hole coaxial with the hole or bore of shaft 1), therefrom projecting a plurality of flexible elongate thin fingers 9 made of plastic material and distributed on an imaginary conical surface (FIGS. 1 and 5) and inclined (FIG. 4) in the movement direction of the yarn running off from the apparatus.

Above said drum, a bell is positioned, having a base wall 10 and a cylindrical peripheral wall 11 spaced from the outer surface of the drum. On the underside of bell wall 10 a shaped annular groove is formed in which, when the bell overlies the drum, the free ends of fingers 9 are accomodated, thus supporting the bell and preventing side movements thereof (this owing to the provision of said shaped groove).

Figure 5:
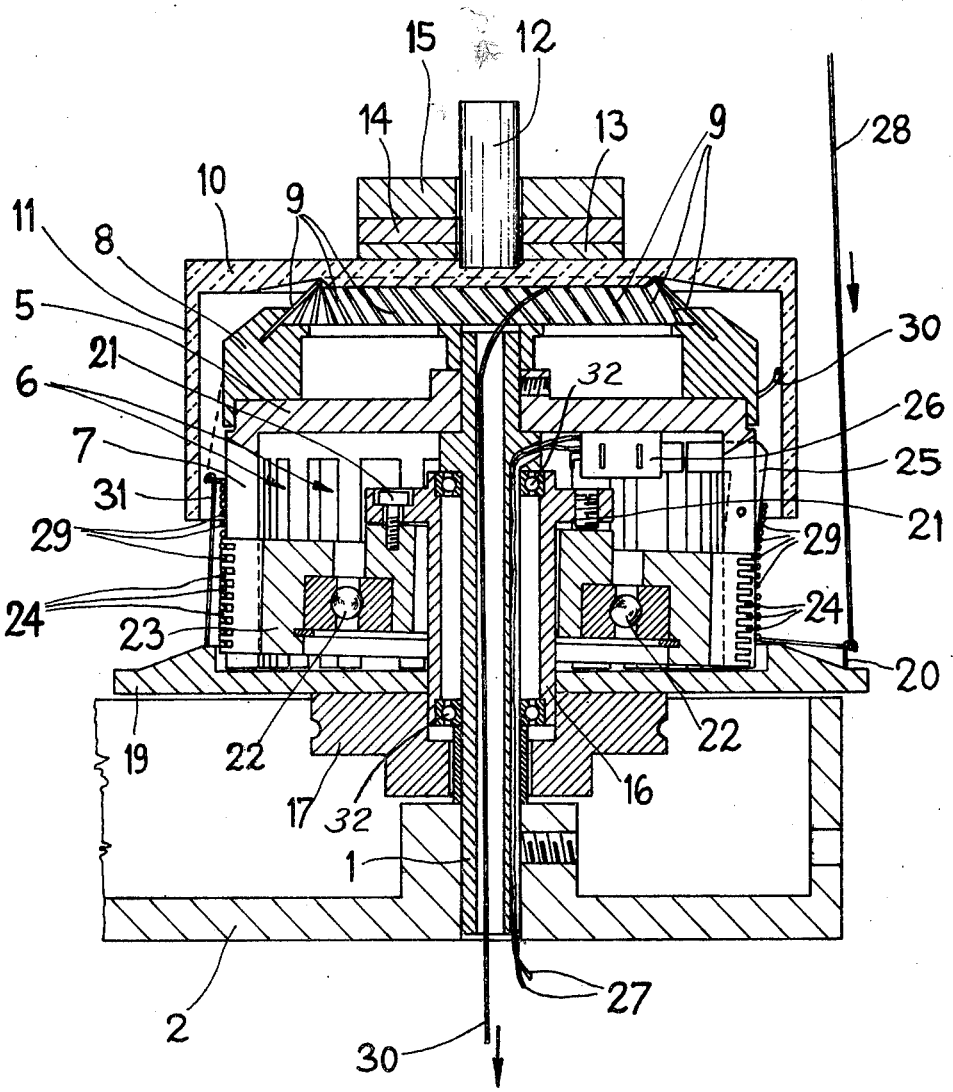
FIG. 5 is an axial sectional view of the apparatus.

A peg or spoke 12 projects from the upper surface of bell wall 10, on which one or more perforated metal discs can be slipped and which, in the embodiment of FIGS. 1 and 5, have been shown three in number, designated by reference numerals 13, 14 and 15, of a different thickness and accordingly of different weight.

By means of two bearings 32 clearly shown in FIG. 5, said shaft 1 has a bush or sleeve 16 mounted thereon, having a pulley 17 fast therewith and coupled to drive pulley 4 by means of a belt 18 (FIG. 1), as well as a rotating arm comprising a pan 19 with a hook 20 projecting therefrom.

Figure 3:
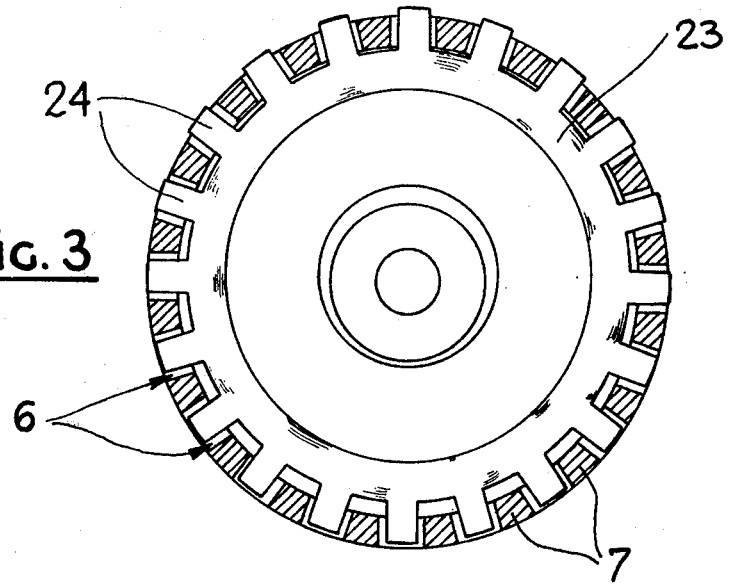

This bush or sleeve 16 also carries through screws 21, of varying the inclination thereof, a rolling bearing 22, the axis of which is accordingly inclined relative to the axis of shaft 1 (FIG. 5). As particularly shown in FIG. 2, the axis of bearing 22 is also laternally displaced relative to the axis of shaft 1, so that, as said bush or sleeve 16 rotates, bearing 22 will swing about shaft 1, as shown also by a comparison of FIGS. 2 and 3, in which the bush or sleeve is shown at two positions angularly rotated by 90° to each other.

Bearing 22 carries an annular body 23, at the periphery of which a plurality of blades or rigid fingers 24 project outwardly radially in spaced superimposed relation in each separate slit 6 of the drum, the size of the blades, as well as the eccentricity and slope of bearing 22, being such that at any position or at any time only those blades, that are positioned at a restricted sector of the drum, will project beyond the outer surface of rods 7, this sector being angularly displaced throughout the drum circumference during rotation of bush or sleeve 16.

Accordingly, as readily apparent, during rotation of said bush or sleeve 16, each of the superimposed group of blades in each slit will radially translate outwardly of the surface of rods 7 and move from bottom to top, followed by a displacement movement inwardly of the drum with a downward displacement movement. As said bush or sleeve 16 rotates, this motion is continuously repeated for each of the group of blades.

Finally, it will be seen from FIG. 5 that a rocking lever 25 is mounted at one of said slits 6 and projects outwardly of the drum, and has a portion thereof adjacent a microswitch 26 internally of the drum and connected to motor 3 by wires 27: thus, depending on the position being taken, said lever 25 can control either the stopping or starting operation of motor 3.

In FIGS. 1 and 5, reference numeral 28 designated a section or length of yarn from a spool (not shown), and reference numerals 29 designates the yarn windings wound up about the durm and 30 designates section or length of yarn being supplied from the apparatus to a yarn using machine (not shown).

During operation of the apparatus, pan 19 rotates with pulley 17 and hook 20 therewith, the latter drawing the yarn from the spool and winding it about said rods 7 adjacent the lower end thereof. Blades 24 are inserted between each winding and those adjacent thereto, causing the same to move slidingly upwards on the outer surface of rods 7. The blades deep the windings separated from one another, which is highly imporatant, since this prevents the windings from overlapping, avoids the risk that a winding might bind against the adjacent windings should the yarn be a pile type of yarn, and prevents the windings from dropping or falling down should the yarn break: this condition is shown in FIG. 1.

If desired, it is apparent that above the zone where said blades 24 can arrive that is at the top of the drum, there could be formed a reserve or supply of yarn windings contacting one another and urged against one another (in which case the outer surface of the drum may be slightly conical or tapered its apex facing upwards), should this be allowed by the yarn nature: this condition is shown in FIG. 5.

The yarn drawn off by the yarn using machine passes through the bore of shaft 1 and runs off at a high speed from the upper end of the drum, forming a balloon which is accomodated within said bell. The yarn passes between the underside of bell wall 10 and the free end of fingers 9, deflecting the latter one at a time. The braking effect of such fingers on the yarn is proportional to the overall weight of the bell and discs 13, 14 and 15 thereon. Since it is very easy and ready to vary the number of said discs, as well as the individual and overall weight thereof, it is a very simple matter to adjust, within vary wide ranges, the braking effect of said fingers 9.

As apparent, said fingers 9 could be integral with the bell and have the free end thereof bearing on the drum plate 8, and said discs could be of a shape other than that shown and be restrained to the bell otherwise than by means of said peg of spoke 12.

When an undue amount of yarn windings is built up on the drum, such windings will act upon lever 25 causing the operation of microswitch 26 and stopping said motor 3, as a result.

On the other hand, when the number of windings wound up on the drum is too low, lever 25 will swing in an opposite direction to said first direction, causing motor 3 to be started The apparatus as far described in suitable to feed either continuously or intermittently yarn with a constant tension to a using machine. Instead, when desiring to supply the same machine with constant lengths of yarn in a time unit, it would suffice to apply a hook 31 to said pan 19 (this hook could also be always provided fast with the pan along with hook 20), extending to the upper end of the drum (FIGS. 1 and 5). The yarn existing from the drum (shown in broken lines in FIGS. 1 and 5) is drawn off by said hook 31 and directly supplied below the bell and then to the bore or hollow of shaft 1. Since pan 19 rotates with a constant speed, and both hook 20 and hook 31 are fast or integral therewith, as a result, as much yarn is wound up on the drum as the yarn being drawn off therefrom, making unnecessary the provision of microswitch 26 and members associated therewith.

Thus, it can be readily understood that the disclosed apparatus can be used under any practical condition, applicable to any textile machine and suitable to deal with any type of yarn.

What I claim is:

1. An apparatus for storing and feeding yarn to a yarn using machine comprising; a substantially upright hollow shaft containing a bore, a substantially cylindrical drum containing an outer surface with upper and lower portions thereof, distributing means for distributing yarn as windings on the said outer surface of said drum and then through said bore of said hollow shaft, driving means for producing relative rotational movement between said distributing means and said drum, translating means for causing said yarn windings to be translated from the lower to the upper portion of said outer surface of said drum while separating said windings from one another, and variable tension controlling means for braking and providing a variable range of tension to the yarn which is leaving said apparatus and being fed to said yarn using machine, said variable tension controlling means comprising; a bell member containing a base wall and a peripheral wall, said bell member being positioned above said drum such that the base wall is spaced apart from the drum top and the peripheral wall is spaced apart from the outer surface of said drum, an annular member coaxial with said shaft and coupled to said drum, and a plurality of inwardly projecting flexible elongated fingers secured to one of said members and having free ends contacting the other member for support of the bell member on the annular member, said fingers being inclined in the direction of the yarn movement during the run off from

2. An apparatus as claimed in claim 1 wherein said distributing means comprises a roller bearing on said shaft, a sleeve on said bearing, a distributor arm fast to said sleeve, and means to rotate said sleeve relative to said shaft.

3. An appartus as claimed in claim 2 wherein said drum is provided with a plurality of longitudinal slits distributed about the periphery of said outer surface and further comprising a second roller bearing on said sleeve, the axis of said second roller bearing being inclined to and eccentric with the axis of said shaft, said translating means comprising a first annular body coaxial with said shaft on said second roller bearing, a plurality of blades projecting radially outwardly from the periphery of said first annular body, said blades being superimposed and spaced apart from one another in groups positioned and swingable in each of said longitudinal slits of said drum.

4. An apparatus for storing yarn and for feeding the thus stored yarn to a yarn utilization machine, said apparatus comprising a substantially upright hollow shaft, a substantially cylindrical drum having an upper end secured to the upper end of said shaft and surrounding said shaft, a distributor arm including means for hooking the yarn from a spool and distributing the yarn as windings on the drum surface adjacent the lower end thereof, drive means for producing relative rotational motion between said arm and drum, said yarn winding being translated from the lower to the upper end of the drum, the yarn being run and drawn off through the hollow shaft to be supplied to the yarn utilization machine, at least one rolling bearing on said shaft, a sleeve supported on said bearing, said distributor arm being secured to said sleeve, said drive means being coupled to said sleeve to rotate the same relative to the hollow shaft, said drum being at least partially passed through by a plurality of longitudinal slits distributed all about the drum periphery, said sleeve carrying at least one rolling bearing having an axis inclined to and eccentric with the shaft, an annular body supported by said shaft, a plurality of blades projecting outwardly radially from the periphery of said annular body, said blades being annularly distributed around said annular body and distributed in groups in which the blades are superimposed on one another, one group of said blades being positioned and swingable in each separate longitudianl slit of said drum, a bell positioned above said drum and having a base wall spaced from the top of the drum, said bell having a substantially cylindrical peripheral wall spaced from the outer surface of the drum, means supporting the bell in spaced relation from the drum including an annular element coaxial with said hollow shaft and a plurality of flexible elongate thin fingers projecting from one of said bell or annular element and having free ends engaging the other of said bell or annular element for supporting the bell, said fingers being inclined in the yarn movement direction during running off from the apparatus.

5. Apparatus as claimed in claim 4 further comprising levelling screws controlling inclination of said annular body with said blades relative to said shaft.

6. Apparatus as claimed in claim 5 wherein said annular element is integral with said drum, and the free ends of the fingers projecting from said annular element are in contact with the base wall of said bell.

7. Apparatus as claimed in claim 6 wherein a shaped annular recess is formed in said base wall of the bell, in which the free ends of said fingers are located.

8. Apparatus as claimed in claim 7 wherein said flexible thin fingers are distributed to define an imaginary substantially conical surface having an apex on the axis of said shaft outside the apparatus.

9. Apparatus as claimed in claim 8 comprising a shaped element for accommodating and holding weights projecting from the upper surface of the base wall of said bell.

10. Apparatus as claimed in claim 9 comprising a rocking lever projecting radially outwardly of the drum through one of said longitudinal slits of said drum, at least one microswitch acted on by said lever to control the operation and stoppage respectively, of said drive means in dependence of the amount of yarn wound on the drum.

11. Apparatus as claimed in claim 10 comprising a rigid structure secured to said arm and carrying a hook for drawing off the yarn from the drum surface, said hook being located remote from the lower end of said drum.

12. Apparatus as claimed in claim 11 wherein said drive means comprises a pulley secured to said sleeve, an electric motor provided with a driving pulley, and a belt connecting the pulley on the sleeve to the driving pulley of the motor.

* * * * *